US006382489B2

(12) United States Patent
Chuang

(10) Patent No.: US 6,382,489 B2
(45) Date of Patent: May 7, 2002

(54) SHOULDER STRAP ASSEMBLY FOR BACKSACKS

(76) Inventor: Louis Chuang, 7F-8 No. 20, Ta Lon Road, Taichung (TW)

( * ) Notice: Subject to any disclaimer, the term of this patent is extended or adjusted under 35 U.S.C. 154(b) by 0 days.

(21) Appl. No.: 09/780,462

(22) Filed: Feb. 12, 2001

Related U.S. Application Data

(63) Continuation-in-part of application No. 09/536,798, filed on Mar. 28, 2000, now abandoned.

(51) Int. Cl.[7] ..... A45F 3/04
(52) U.S. Cl. ..... 224/637; 224/575; 224/153
(58) Field of Search ..... 224/575, 153, 224/627, 637, 640

(56) References Cited

U.S. PATENT DOCUMENTS 3,860,157 A * 1/1975 Richards et al. ..... 224/153
4,223,819 A * 9/1980 Wright ..... 190/115
5,131,576 A * 7/1992 Turnipseed ..... 224/262
5,564,612 A * 10/1996 Gregory ..... 224/633
5,634,576 A * 6/1997 Arbel ..... 224/153
5,732,867 A * 3/1998 Perkins et al. ..... 224/628
6,216,926 B1 * 4/2001 Pratt ..... 224/153
6,311,884 B1 * 11/2001 Johnson ..... 224/153

* cited by examiner

*Primary Examiner*—Stephen P. Garbe
(74) *Attorney, Agent, or Firm*—Rosenberg, Klein & Lee

(57) ABSTRACT

A backsack includes a pouch with two first buckle members attached thereto. A positioning device is secured to the pouch. A shoulder strap unit includes two shoulder straps each having a second buckle member for releasably engaging with an associated first buckle member. An engaging device is mounted to the shoulder strap unit and is releasably engaged with the positioning device on the pouch, thereby releasably attach the shoulder strap unit to the pouch.

6 Claims, 6 Drawing Sheets

SHOULDER STRAP ASSEMBLY FOR BACKSACKS

CROSS REFERENCE TO RELATED APPLICATION

This is a continuation-in-part application of U.S. patent application Ser. No. 09/536,798 filed on Mar. 28, 2000, which is now abandoned.

BACKGROUND OF THE INVENTION

1. Field of the Invention

The present invention relates to a shoulder strap assembly that can be releasably attached to backsacks or backpacks of different sizes.

2. Description of the Related Art

In a typical backsack or backpack, the shoulder straps are attached to the pouch of the backsack by sewing, which is labor-intensive and requires a skilled worker, as the shoulder straps are sewn to different faces. In addition, the users often have to buy backsacks of different sizes and shapes for different utility. The present invention is intended to provide a shoulder strap assembly that can be releasably attached to a backsack or the like to mitigate and/or obviate the above problems.

SUMMARY OF THE INVENTION

It is an object of the present invention to provide a shoulder strap assembly that can be releasably attached to a backsack or backpack to thereby lower the cost of backsacks or backpacks.

It is another object of the present invention to provide a shoulder strap assembly that can be attached to a backsack or the like without sewing work to thereby lower the manufacture cost.

A backsack in accordance with the present invention comprises:

a pouch including two first buckle members attached thereto;

a positioning means secured to the pouch;

a shoulder strap unit including two shoulder straps each having a second buckle member for releasably engaging with an associated said first buckle member; and an engaging means mounted to the shoulder strap unit and releasably engaged with the positioning means on the pouch.

In an embodiment of the invention, the positioning means includes: a plate securely mounted to an upper portion of a rear side of the pouch, two horizontally extending engaging strips provided on the plate, each engaging strip having an engaging groove defined in an underside thereof, and two spaced vertical ribs having a vertical guide passage formed therebetween. The shoulder strap unit is substantially U-shape with a mediate portion. The engaging means includes a fixing plate secured to the mediate portion of the shoulder strap unit, the fixing plate including two ends and a mediate portion. An engaging plate includes a mediate portion secured to the mediate portion of the fixing plate. The engaging plate further includes two side portions, each side portion having a vertical wall, the vertical wall and an associated end of the fixing plate having a gap therebetween. A flexible tab extends upward from the mediate portion of the engaging plate and has a step formed on an underside thereof. The flexible tab is bent away from the pouch and guided vertically upward through the vertical guide passage when attaching the shoulder strap unit to the positioning means. The flexible tab returns to an upright position with the step resting on an upper edge of the plate when the flexible tab leaves the vertical guide passage. The vertical wall of each side portion of the engaging plate is engaged with the engaging groove of an associated engaging strip. The vertical rib is engaged in an associated vertical slot.

The pouch further comprises two waist straps attached thereto, wherein one of the waist straps has a male buckle member and the other one of the waist straps has a female buckle member for releasably engaging with the male buckle member. The first buckle members of the pouch are provided on the waist straps, respectively.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
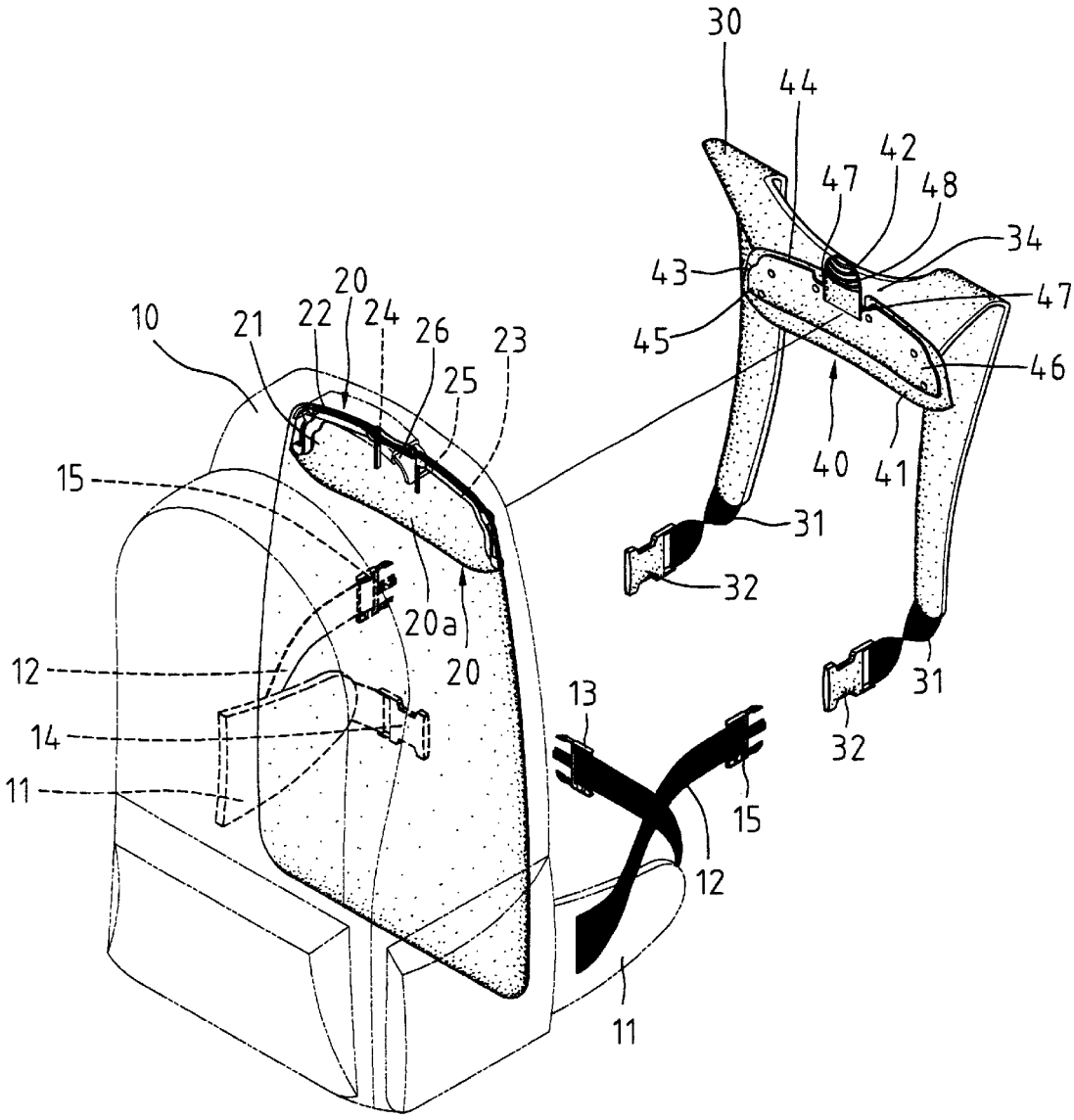
FIG. 1 is a front exploded perspective view of a backsack with a shoulder strap assembly in accordance with the present invention.
Figure 2:
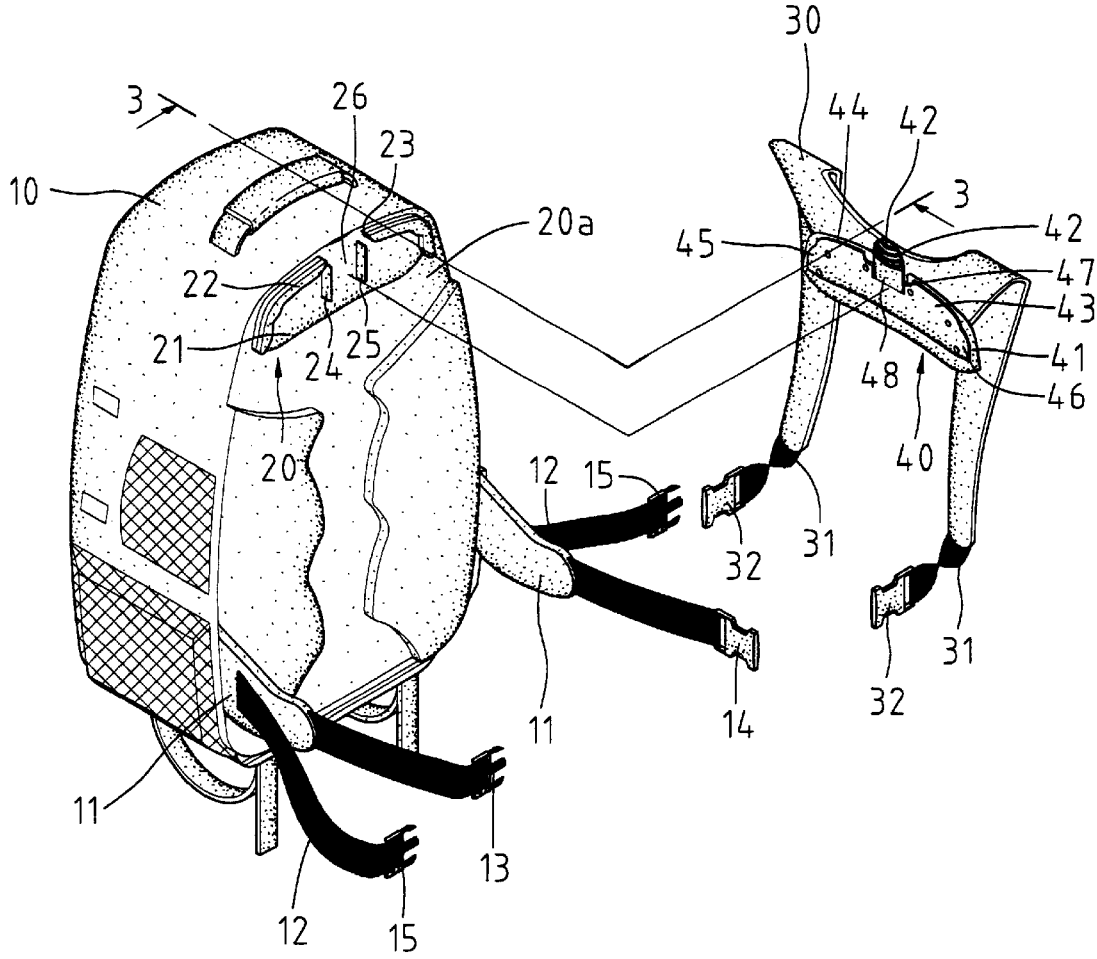
FIG. 2 is a rear exploded perspective view of the backsack in FIG. 1.

Referring to FIGS. 1 and 2, a shoulder strap assembly in accordance with the present invention is adapted to be attached to a bag or pouch 10 to form a backsack, backpack, or the like. The pouch 10 includes a pair of waist straps 11 attached thereto, wherein one of the waist straps 11 has a male buckle member 13 attached thereto for releasably engaging with a female buckle member 14 provided on the other waist strap 11. In addition, two straps 12 are attached to the pouch 10 and each includes a male buckle member 15. In this embodiment, the straps 12 are extended from a main portion of an associated waist strap 11.

Figure 3:
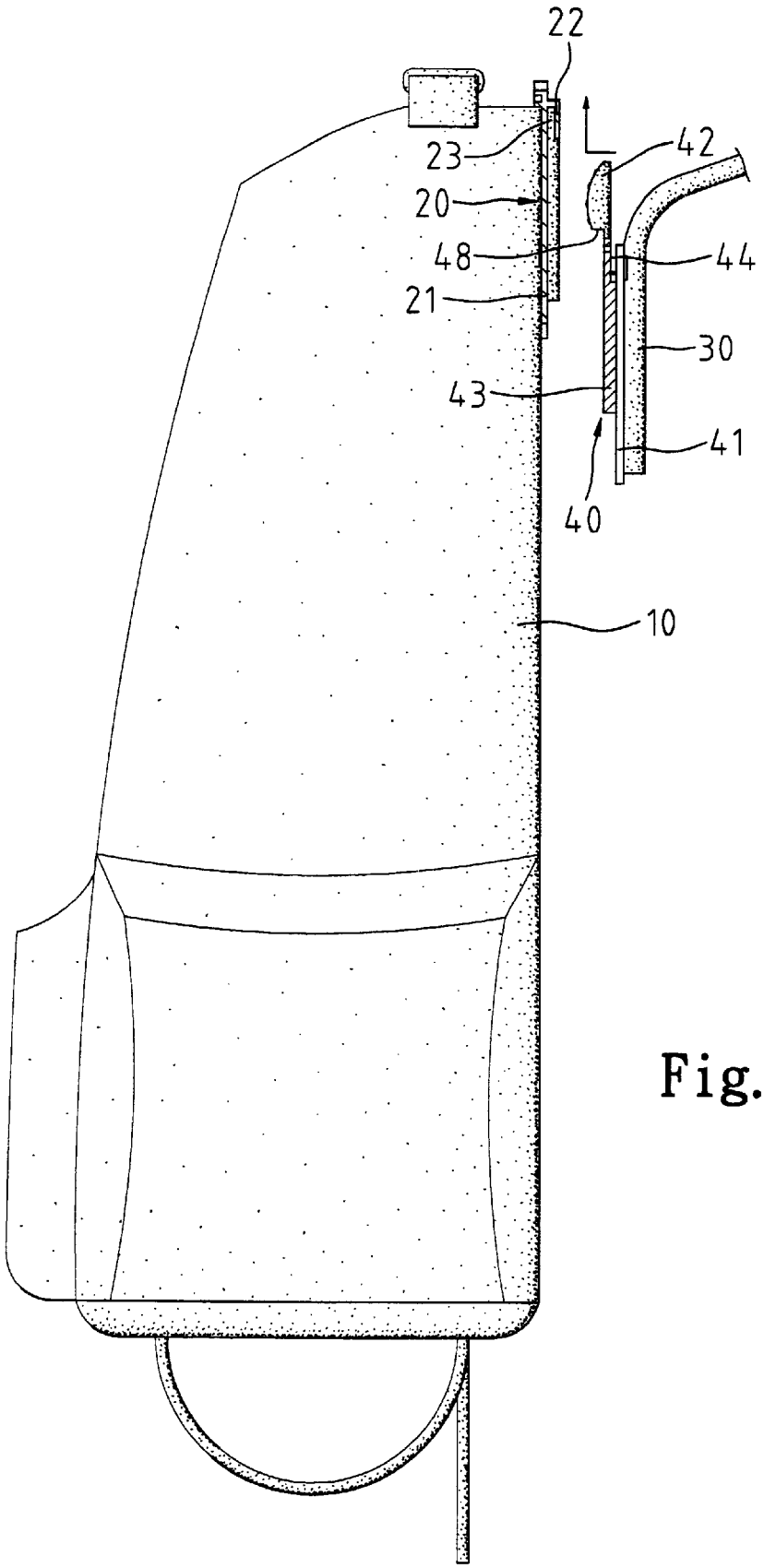
FIG. 3 is a side view, partly sectioned along line 3—3 in FIG. 2, of the backsack, illustrating attachment of the shoulder strap assembly.
Figure 5:
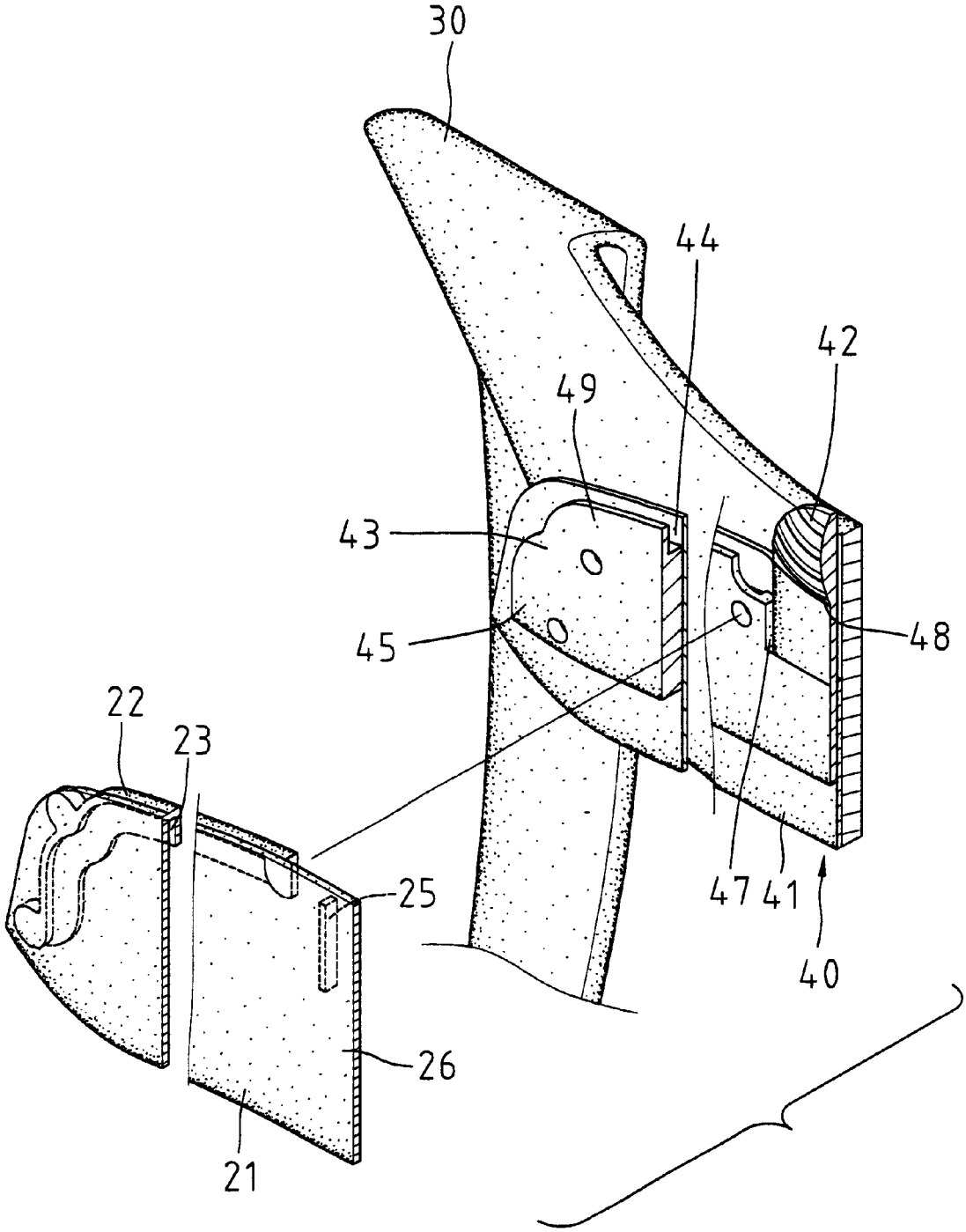
FIG. 5 is an enlarged exploded perspective view illustrating detailed structure of a positioning means and a shoulder strap unit of the present invention.

The shoulder strap assembly in accordance with the present invention includes a positioning means 20, a shoulder strap unit 30, and an engaging means 40. The positioning means 20 in this embodiment is a plate 20*a* securely mounted (e.g., by riveting or other suitable means) to an upper portion of a rear side of the pouch 10. As illustrated in FIGS. 2 and 5, the positioning means 20 further includes a pair of horizontally spaced engaging seats 21 formed on the plate 20*a*, each engaging seat 21 having an engaging strip 22 with an engaging groove 23 in an underside thereof, best shown in FIG. 5. Each engaging seat 21 includes a vertical plate 24, 25 to form a vertical guide passage 26 by the two spaced vertical ribs 24 and 25. It is noted that the vertical rib 24, 25 is separate from the associated engaging strip 21. The shoulder strap unit 30 is substantially U-shape and includes a strap 31 attached to each of two ends thereof, each strap 31 having a female buckle member 32 attached thereto. The engaging means 40 includes a fixing plate 41 secured (e.g., by riveting or other suitable means) to a mediate portion 34 (FIG. 1) of the shoulder strap unit 30. An engaging plate 43 includes a mediate portion (not labeled) secured to a mediate portion (not labeled) of the fixing plate 41. The engaging plate 43 further includes two side portions 45 and 46 each having an upper wall 49 (FIG. 5), wherein the upper wall 49 of each side portion 45, 46 and an associated end of the fixing plate 41 have a gap 44 therebetween, as shown in FIGS. 3 and 5. A flexible tab 42 extends upward from the mediate portion of the engaging plate 43 and has a step 48 formed on an underside thereof. In addition, each side portion 45, 46 of the engaging plate 43 has a vertical slot 47, which will be described later.

Figure 4:
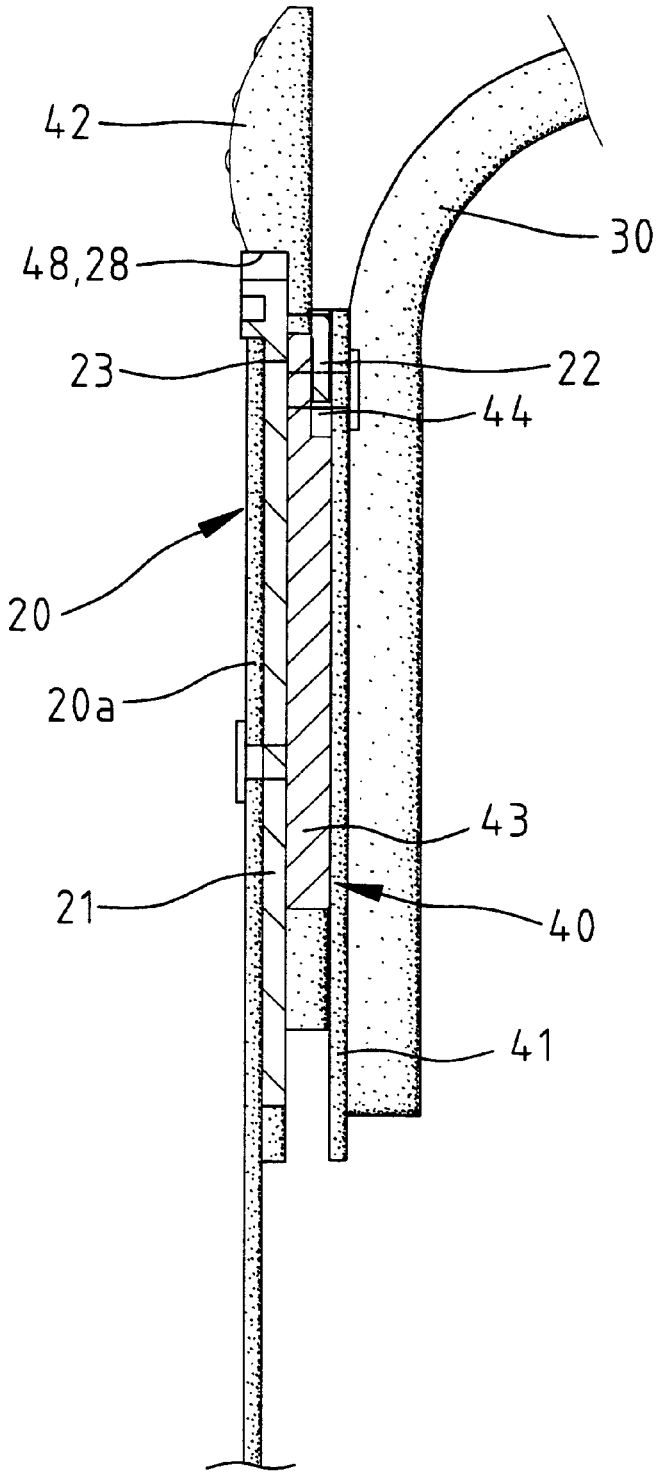
FIG. 4 is an enlarged sectional view of a portion of FIG. 3, wherein the shoulder strap assembly is attached to the pouch of the backsack.

In assembly, as illustrated in FIG. 3, the shoulder strap unit 30 is firstly placed below the engaging seats 21. Then the tab 42 is slid upward along the guide passage 26 until it reaches a position shown in FIG. 4. It is noted that the tab 42 is bent away from the pouch 10 during the vertical movement in the guide passage 26, and the tab 42 returns to its upright position due to its flexibility. Thus, the step 48 of the tab 42 rests on an upper edge 28 (FIG. 4) of the plate 20*a*. Downward movement of the shoulder strap unit 30 is prevented unless the tab 42 is firstly pushed away from the engaging seat 21 and then moved downward. In addition, the upper walls 49 of the engaging plate 43 are securely engaged with the engaging grooves 23 of the engaging strips 22, respectively. In addition, each vertical rib 24, 25 is moved into an associated vertical slot 47. Thus, a reliable and releasable engagement between the positioning means 20 and the shoulder strap unit 30 is provided. The female buckle members 32 on the shoulder strap unit 30 may be releasably engaged with the male buckle members 15 of the straps 12, thereby forming a backsack.

Figure 8:
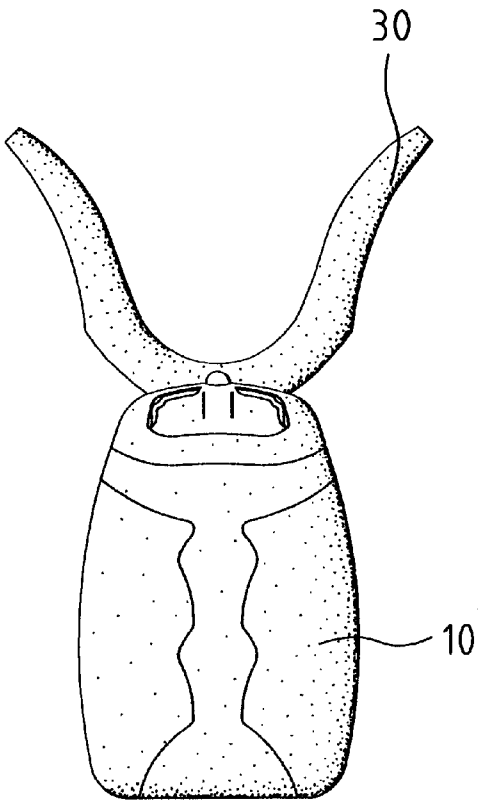
FIG. 8 is a front view illustrating attachment of the shoulder strap assembly in accordance with the present invention to a large pouch.
Figure 7:
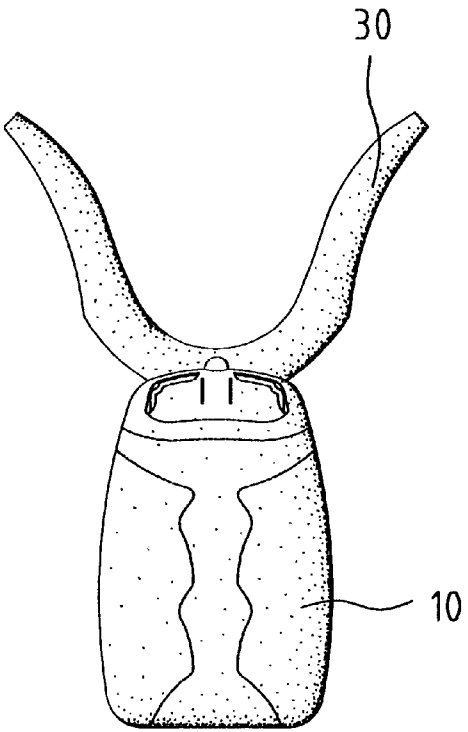
FIG. 7 is a front view illustrating attachment of the shoulder strap assembly in accordance with the present invention to a medium-size pouch.
Figure 6:
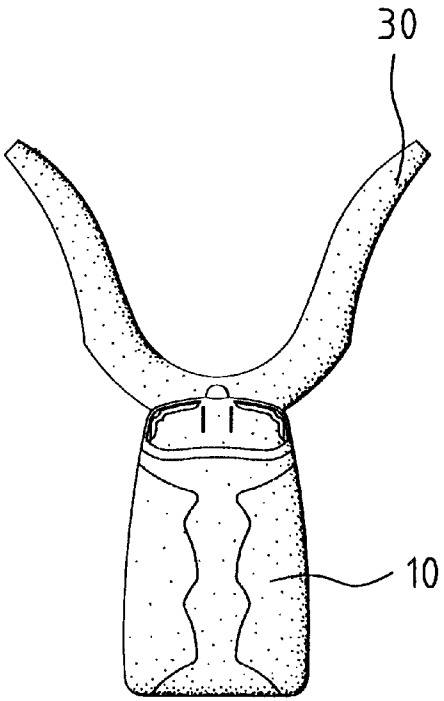
FIG. 6 is a front view illustrating attachment of the shoulder strap assembly in accordance with the present invention to a small pouch.

As illustrated in FIGS. 6 through 8, the shoulder strap unit 30 in accordance with the present invention can be attached to pouches or bags of different sizes such that the user may buy only one shoulder strap unit 30 to match backsacks or backpacks of different sizes and shapes for different utility. No sewing work is required for attaching the shoulder strap unit 30 to the pouches or bags.

Although the invention has been explained in relation to its preferred embodiment, it is to be understood that many other possible modifications and variations can be made without departing from the spirit and scope of the invention as hereinafter claimed.

What is claimed is:

1. A backsack comprising:

a pouch including at least one first buckle member attached thereto;

a positioning means secured to the pouch;

a shoulder strap unit including at least one shoulder strap having a second buckle member for releasably engaging with said at least one first buckle member; and an engaging means mounted to the shoulder strap unit and releasably engaged with the positioning means on the pouch.

2. The backsack as claimed in claim 1, wherein the positioning means includes:

a plate securely mounted to an upper portion of a rear side of the pouch;

two horizontally extending engaging strips provided on the plate, each said engaging strip having an engaging groove defined in an underside thereof; and two spaced vertical ribs having a vertical guide passage formed therebetween;

the shoulder strap unit being substantially U-shape with a mediate portion;

the engaging means including:

a fixing plate secured to the mediate portion of the shoulder strap unit, the fixing plate including two ends and a mediate portion;

an engaging plate including a mediate portion secured to the mediate portion of the fixing plate, the engaging plate further including two side portions, each said side portion having a vertical wall, the vertical wall and an associated said end of the fixing plate having a gap therebetween; and a flexible tab extended upward from the mediate portion of the engaging plate and having a step formed on an underside thereof, the flexible tab being bent away from the pouch and guided vertically upward through the vertical guide passage when attaching the shoulder strap unit to the positioning means, and the flexible tab returns to an upright position with the step resting on an upper edge of the plate when the flexible tab leaves the vertical guide passage, said vertical wall of each said side portion of the engaging plate being engaged with said engaging groove of an associated said engaging strip, said vertical rib being engaged in an associated said vertical slot.

3. A backsack comprising:

a pouch including two first buckle members attached thereto;

a positioning means secured to the pouch;

a shoulder strap unit including two shoulder straps each having a second buckle member for releasably engaging with an associated said first buckle member; and an engaging means mounted to the shoulder strap unit and releasably engaged with the positioning means on the pouch.

4. The backsack as claimed in claim 3, wherein the positioning means includes:

a plate securely mounted to an upper portion of a rear side of the pouch;

two horizontally extending engaging strips provided on the plate, each said engaging strip having an engaging groove defined in an underside thereof; and two spaced vertical ribs having a vertical guide passage formed therebetween;

the shoulder strap unit being substantially U-shape with a mediate portion;

the engaging means including:

a fixing plate secured to the mediate portion of the shoulder strap unit, the fixing plate including two ends and a mediate portion;

an engaging plate including a mediate portion secured to the mediate portion of the fixing plate, the engaging plate further including two side portions, each said side portion having a vertical wall, the vertical wall and an associated said end of the fixing plate having a gap therebetween; and a flexible tab extended upward from the mediate portion of the engaging plate and having a step formed on an underside thereof, the flexible tab being bent away from the pouch and guided vertically upward through the vertical guide passage when attaching the shoulder strap unit to the positioning means, and the flexible tab returns to an upright position with the step resting on an upper edge of the plate when the flexible tab leaves the vertical guide passage, said vertical wall of each said side portion of the engaging plate being engaged with said engaging groove of an associated said engaging strip, said vertical rib being engaged in an associated said vertical slot.

5. The backsack as claimed in claim 4, wherein the pouch further comprises two waist straps attached thereto, wherein one of the waist straps has a male buckle member and the other one of the waist straps has a female buckle member for releasably engaging with the male buckle member.

6. The backsack as claimed in claim 5, wherein the first buckle members of the pouch are provided on the waist straps, respectively.

* * * * *